US006082165A

United States Patent [19]

Ortiz

[11] Patent Number: 6,082,165

[45] Date of Patent: Jul. 4, 2000

[54] COLLAR HOLE DIE

[76] Inventor: Narciso Ortiz, 7445 Sky King, Corpus Christi, Tex. 78412

[21] Appl. No.: 09/244,401

[22] Filed: Feb. 4, 1999

[51] Int. Cl.[7] ..... B21D 28/14; B21D 45/06

[52] U.S. Cl. ..... 72/328; 72/327; 72/467; 29/890.052

[58] Field of Search ..... 72/327, 328, 329, 72/335, 334, 333, 467; 83/690; 29/890.052

[56] References Cited

U.S. PATENT DOCUMENTS

| | | | |
|---|---|---|---|
| 798,530 | 8/1905 | Rehfuss | 72/328 |
| 819,639 | 5/1906 | Eustice | 72/328 |
| 1,793,296 | 2/1931 | Wilson | 72/333 |
| 3,245,465 | 4/1966 | Young | 72/327 |
| 3,776,016 | 12/1973 | Quinn | 72/333 |
| 4,555,928 | 12/1985 | Delio | 72/467 |

FOREIGN PATENT DOCUMENTS

| | | | |
|---|---|---|---|
| 212132 | 12/1984 | Japan | 72/327 |
| 846046 | 7/1981 | U.S.S.R. | 72/327 |
| 665414 | 1/1952 | United Kingdom | 83/690 |

*Primary Examiner*—Daniel C. Crane

[57] ABSTRACT

A collar hole die for forming a hole in brass headers used in radiators with a collar around the periphery of the hole. The collar hole die includes a body with top and bottom faces, and an outer side. The body has a center bore extending therethrough between the top and bottom faces of the body. The top face of the body has an annular extent upwardly extending therefrom around the outer periphery of the center bore. The annular extent has an upper, inner and outer portions. The inner portion of the annular extent has an annular inner recess therearound adjacent the upper portion of the annular extent.

16 Claims, 3 Drawing Sheets

COLLAR HOLE DIE

BACKGROUND OF THE INVENTION

1. Field of the Invention

The present invention relates to dies for forming a hole in brass headers used in radiators with a collar around the periphery of the hole and more particularly pertains to a new collar hole die for forming a hole in brass headers used in radiators with a collar around the periphery of the hole.

2. Description of the Prior Art

The use of dies for forming a hole in brass headers used in radiators with a collar around the periphery of the hole is known in the prior art. More specifically, dies for forming a hole in brass headers used in radiators with a collar around the periphery of the hole heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,956,989 by Nakajima; U.S. Pat. No. 4,098,108 by Kozima; U.S. Pat. No. 2,308,953 by Brown; U.S. Pat. No. 5,600,992 by Kanazawa et al.; U.S. Pat. No. 5,722,280 by Bodnar; and U.S. Pat. No. Des. 286,500 by Jaques et al.

While these devices fulfill their respective, particular objectives and requirements, the aforementioned patents do not disclose a new collar hole die. The inventive device includes a body with top and bottom faces, and an outer side. The body has a center bore extending therethrough between the top and bottom faces of the body. The top face of the body has an annular extent upwardly extending therefrom around the outer periphery of the center bore. The annular extent has an upper, inner and outer portions. The inner portion of the annular extent has an annular inner recess therearound adjacent the upper portion of the annular extent.

In these respects, the collar hole die according to the present invention substantially departs from the conventional concepts and designs of the prior art, and in so doing provides an apparatus primarily developed for the purpose of forming a hole in brass headers used in radiators with a collar around the periphery of the hole.

SUMMARY OF THE INVENTION

In view of the foregoing disadvantages inherent in the known types of dies for forming a hole in brass headers used in radiators with a collar around the periphery of the hole now present in the prior art, the present invention provides a new collar hole die construction wherein the same can be utilized for forming a hole in brass headers used in radiators with a collar around the periphery of the hole.

The general purpose of the present invention, which will be described subsequently in greater detail, is to provide a new collar hole die apparatus and method which has many of the advantages of the dies for forming a hole in brass headers used in radiators with a collar around the periphery of the hole mentioned heretofore and many novel features that result in a new collar hole die which is not anticipated, rendered obvious, suggested, or even implied by any of the prior art dies for forming a hole in brass headers used in radiators with a collar around the periphery of the hole, either alone or in any combination thereof.

To attain this, the present invention generally comprises a body with top and bottom faces, and an outer side. The body has a center bore extending therethrough between the top and bottom faces of the body. The top face of the body has an annular extent upwardly extending therefrom around the outer periphery of the center bore. The annular extent has an upper, inner and outer portions. The inner portion of the annular extent has an annular inner recess therearound adjacent the upper portion of the annular extent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collar hole die apparatus and method which has many of the advantages of the dies for forming a hole in brass headers used in radiators with a collar around the periphery of the hole mentioned heretofore and many novel features that result in a new collar hole die which is not anticipated, rendered obvious, suggested, or even implied by any of the prior art dies for forming a hole in brass headers used in radiators with a collar around the periphery of the hole, either alone or in any combination thereof.

It is another object of the present invention to provide a new collar hole die which may be easily and efficiently manufactured and marketed.

It is a further object of the present invention to provide a new collar hole die which is of a durable and reliable construction.

An even further object of the present invention is to provide a new collar hole die which is susceptible of a low cost of manufacture with regard to both materials and labor, and which accordingly is then susceptible of low prices of sale to the consuming public, thereby making such collar hole die economically available to the buying public.

Still yet another object of the present invention is to provide a new collar hole die which provides in the apparatuses and methods of the prior art some of the advantages thereof, while simultaneously overcoming some of the disadvantages normally associated therewith.

Still another object of the present invention is to provide a new collar hole die for forming a hole in brass headers used in radiators with a collar around the periphery of the hole.

Yet another object of the present invention is to provide a new collar hole die which includes a body with top and bottom faces, and an outer side. The body has a center bore extending therethrough between the top and bottom faces of the body. The top face of the body has an annular extent upwardly extending therefrom around the outer periphery of the center bore. The annular extent has an upper, inner and outer portions. The inner portion of the annular extent has an annular inner recess therearound adjacent the upper portion of the annular extent.

Still yet another object of the present invention is to provide a new collar hole die that may be used in a die turret of a 1¼" strippet. This eliminates the need to use slow presses traditionally used to punch brass header.

Even still another object of the present invention is to provide a new collar hole die that can be used for punching holes in light and heavy gauge brass with the relief portion of the hole extending downward rather than upwards.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
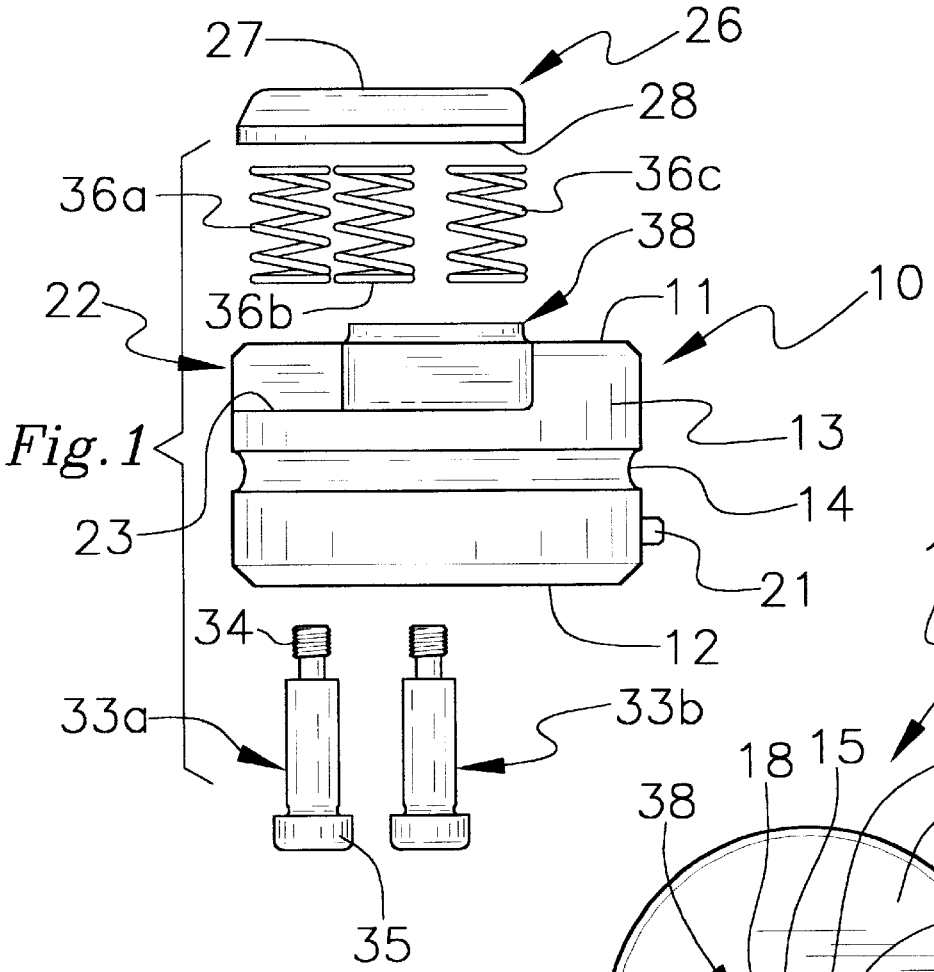
FIG. 1 is a schematic exploded side view of a new collar hole die according to the present invention.

With reference now to the drawings, and in particular to FIGS. 1 through 7 thereof, a new collar hole die embodying the principles and concepts of the present invention will be described.

As best illustrated in FIGS. 1 through 7, the collar hole die generally comprises a body with top and bottom faces, and an outer side. The body has a center bore extending therethrough between the top and bottom faces of the body. The top face of the body has an annular extent upwardly extending therefrom around the outer periphery of the center bore. The annular extent has an upper, inner and outer portions. The inner portion of the annular extent has an annular inner recess therearound adjacent the upper portion of the annular extent.

In use, the die is designed for use in a punch and die machine for forming a hole in a sheet-metal material so that the formed hole has an annular collar around the periphery of the hole outwardly extending from a face of the sheet metal material. In closer detail, the die comprises a generally disk-shaped body 10 having a center axis, substantially planar and generally circular top and bottom faces 11,12, and a generally cylindrical outer side 13. The top and bottom faces of the body preferably lie in planes substantially parallel to one another and substantially perpendicular to the center axis of the body. In an ideal illustrative embodiment, the body has a height defined between the top and bottom faces of the about 1 3/16 inches and a diameter defined substantially perpendicular to the center axis of about 1 7/8 inches.

Preferably, the outer side of the body has an annular channel 14 therearound. The annular channel of the outer side lies in a plane substantially parallel to the top and bottom faces of the body. The plane of the annular channel of the outer side is preferably spaced generally equidistant between the top and bottom faces of the body. The annular channel of the outer side has a generally arcuate transverse cross section taken in a plane in which the center axis of the body lies with an outwardly facing concavity.

Figure 2:
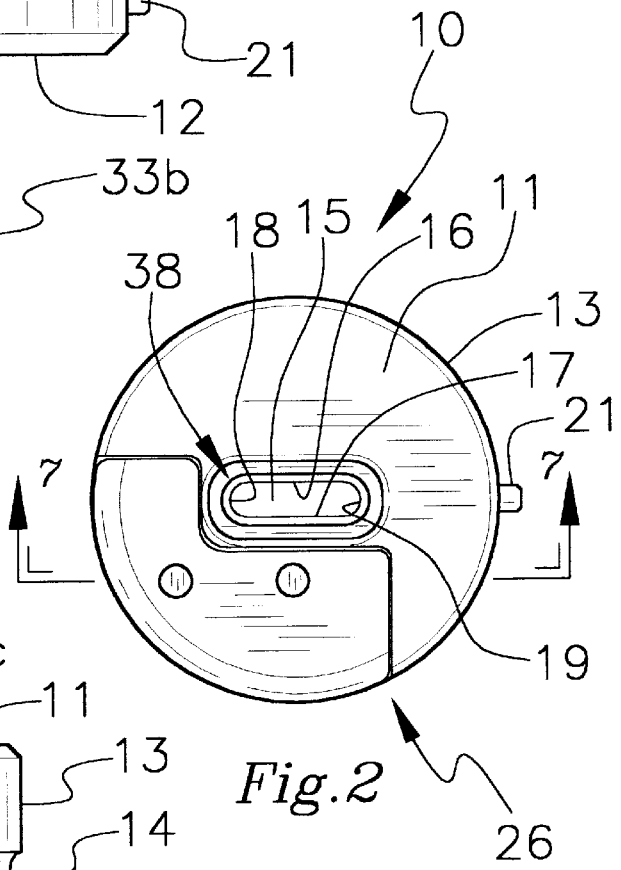
FIG. 2 is a schematic top view of the assembled present invention.

The body has a generally oblong center bore 15 extending therethrough between the top and bottom faces of the body at the center axis of the body. In use, the center bore is designed for extending a punch therethrough to form a hole in a sheet metal material positioned between the punch and the top face of the body. The center bore of the body has a transverse axis extending substantially perpendicular to the center axis of the body and substantially parallel to the top and bottom faces of the body. As best illustrated in FIG. 2, the center bore of the body has an outer periphery comprising a pair of substantially parallel straight sides 16,17 extending substantially parallel to the transverse axis of the center bore, and a pair of arcuate sides 18,19 extending between the straight sides of the center bore.

Figure 5:
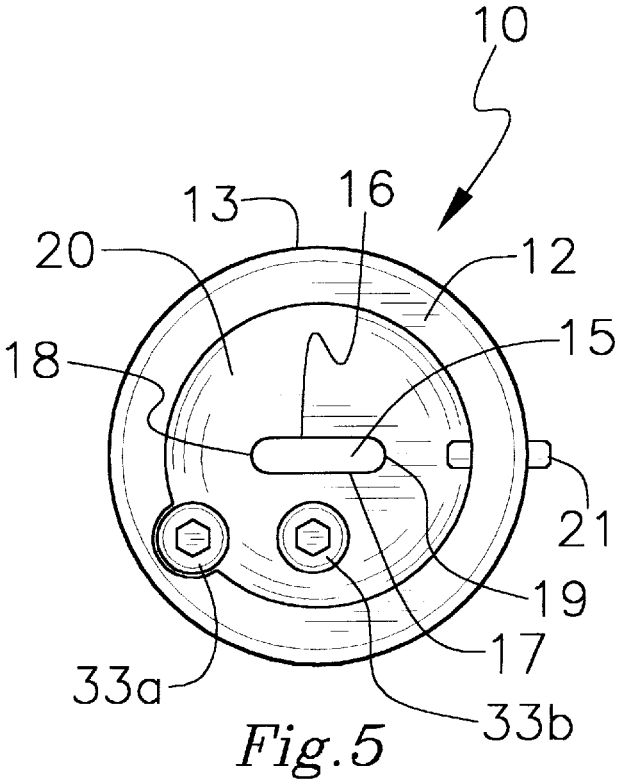
FIG. 5 is a schematic bottom view of the present invention.
Figure 6:
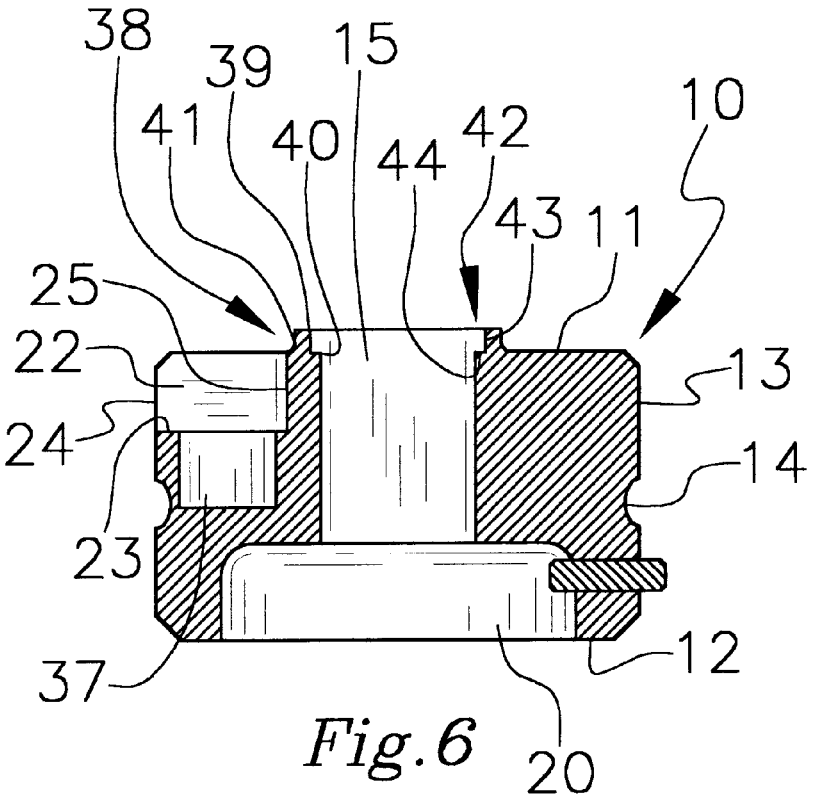
FIG. 6 is a schematic cross sectional view of the body of the present invention taken from line 6—6 of FIG. 4.

The bottom face of the body has a generally cylindrical lower cavity 20 therein. With reference to FIGS. 5 and 6, the lower cavity of the bottom face has a center coaxial with the center axis of the body such that the outer side of the body and an outer side wall of the lower cavity are concentric. The center bore of the body opens into the lower cavity of the bottom face.

A generally cylindrical elongate pin 21 is extended through the body from the outer side of the body into the lower cavity of the bottom face. The pin has an axis extending substantially perpendicular to the center axis of the body and substantially parallel to the top and bottom faces of the body. Preferably, the axis of the pin is extended substantially parallel to the transverse axis of the center bore.

Figure 4:
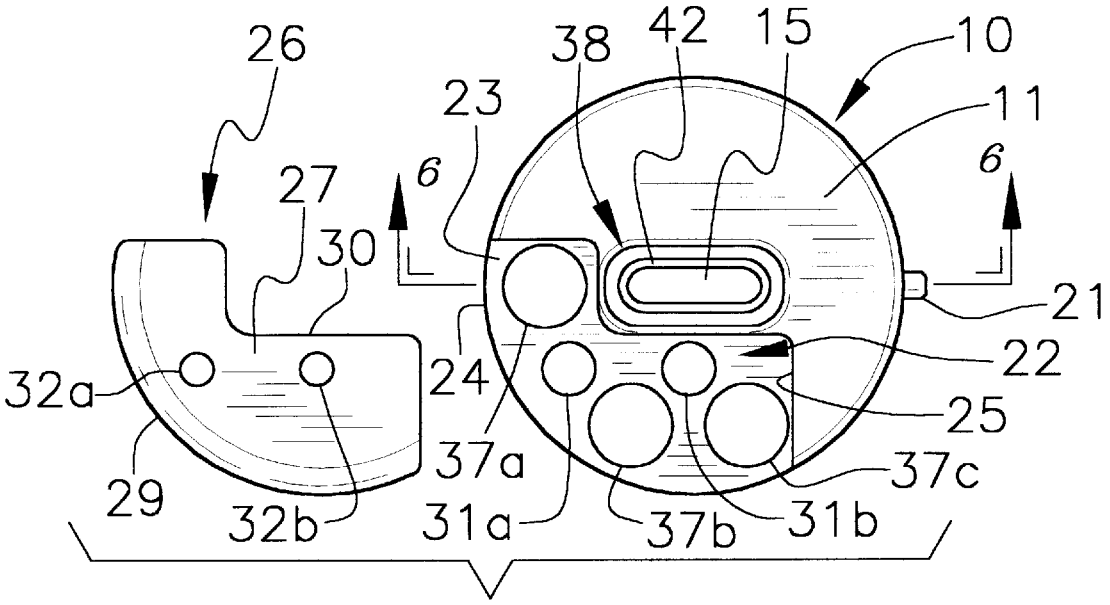
FIG. 4 is a schematic exploded top view of the present invention.
Figure 7:
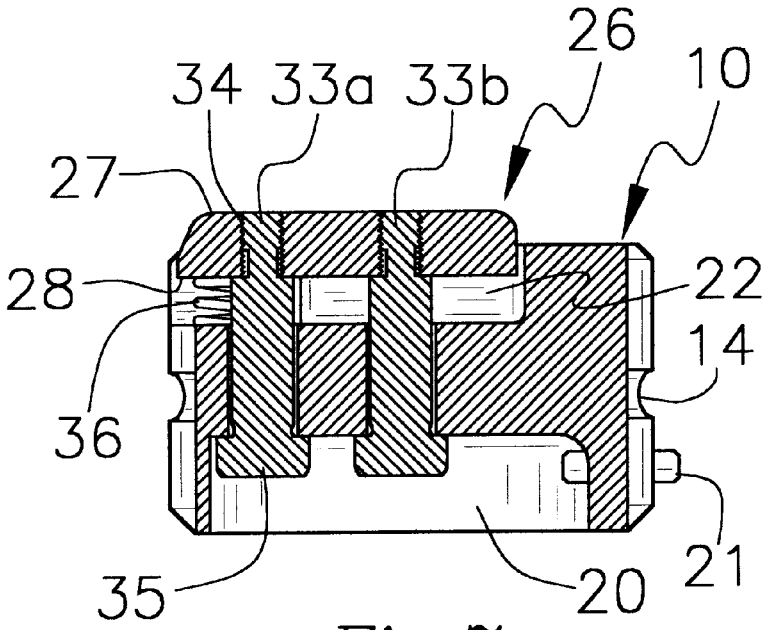
FIG. 7 is a schematic cross sectional view of the assembled present invention taken from line 7—7 of FIG. 2.

As best illustrated in FIGS. 4, 6 and 7, the top face of the body has generally L-shaped upper recess 22 therein. The upper recess has a lower surface 23, an open outer side periphery 24 along the outer side of the body and a generally L-shaped inner side 25 periphery adjacent the center bore of the body. The lower surface of the upper recess preferably lies in a plane substantially parallel to the top face of the body. The inner side periphery of the upper recess is extended adjacent one of the straight sides of the center bore and one of the arcuate sides of the center bore.

A generally L-shaped stripper plate 26 is disposed in the upper recess of top face of the body. The stripper plate has substantially planar and parallel upper and lower faces 27,28, an arcuate outer side 29, and a generally L-shaped inner side 30. The lower face of the stripper plate faces the lower surface of the upper recess. The outer side of the stripper plate is positioned adjacent the open outer side periphery of the upper bore. The inner side of the stripper plate is positioned adjacent the inner side periphery of the upper recess.

Preferably, the body has a pair of generally cylindrical set holes 31*a*,31*b* extending therethrough between the lower surface of the upper recess and the lower cavity of the bottom face of the body. The stripper plate has a pair of threaded holes 32*a*,32*b* therethrough. Each of the threaded holes of the stripper plate is coaxially aligned with a corresponding set hole of the pair of set holes of the body. A pair of elongate set pins 33*a*,33*b* are provided each having a threaded upper end 34 and a lower stop 35 opposite the upper end of the respective set pin. Each of the set pins is associated with a corresponding associated threaded hole of the stripper plate and set hole of the body. The set pins each are extended through the associated set holes with the threaded upper end of each set pin is threadably inserted into the associated threaded hole of the stripper plate. As best illustrated in FIG. 7, the lower stop of each set pin is positioned in the lower cavity of the bottom face of the body.

Figure 3:
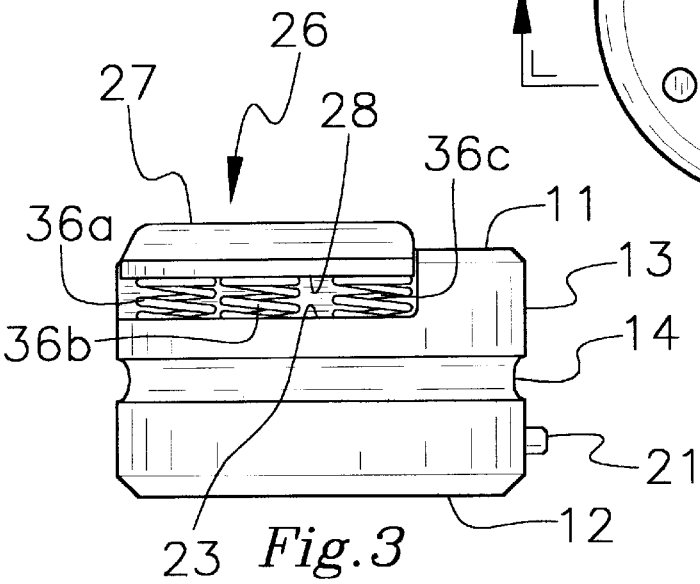
FIG. 3 is a schematic side view of the present invention.

A plurality of springs 36*a*,36*b*,36*c* are positioned in the upper recess between the lower surface of the upper recess and the lower face of the stripper plate. Preferably, the body has a plurality of spring holes 37*a*,37*b*,37*c* in the lower surface of the upper recess. Each of the springs is associated with one of the spring holes with each spring being extended into the associated spring hole. In use, the springs bias the stripper plate upwards from the top face of the body such that the upper face of the stripper plate is biased to a position lie in a plane above the top face of the body as illustrated in FIG. 3.

The top face of the body has an annular extent 38 upwardly extending therefrom around the outer periphery of the center bore. With reference to FIG. 6, the annular extent has an upper, inner and outer portions 39,40,41. The inner and outer portions of the annular extent are extended generally parallel to one another generally perpendicular to the top face of the body. The upper portion of the annular extent is extended generally perpendicular to the inner and outer portions of the annular extent and generally parallel to the top face of the body.

The inner portion of the annular extent has an annular inner recess 42 therearound adjacent the upper portion of the annular extent. The inner recess has a generally L-shaped inner periphery having an upper portion 43 and a lower portion 44 extending substantially perpendicular to the upper portion of the inner periphery of the inner recess. The upper portion of the inner periphery of the inner recess is extended substantially parallel to the inner portion of the annular extent. The lower portion of the inner periphery of the inner recess is extended substantially parallel to the top face of the body. In use, the inner recess is designed for permitting sheet metal material around the periphery of a hole formed in the sheet metal material by the center bore and a punch to form an annular collar extending outwardly from one face of the sheet metal material around the periphery of the hole in the sheet metal material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A die, comprising:

a body having a center axis, top and bottom faces, and an outer side;

said body having a center bore extending therethrough between said top and bottom faces of said body at said center axis of said body, said center bore of said body having an outer periphery;

said top face of said body having an annular extent upwardly extending therefrom around said outer periphery of said center bore;

said annular extent having an upper, inner and outer portions;

said inner portion of said annular extent having an annular inner recess therearound adjacent said upper portion of said annular extent;

wherein said bottom face of said body has a lower cavity therein, said center bore of said body opening into said lower cavity of said bottom face; and an elongate pin being extended through said body from said outer side of said body into said lower cavity of said bottom face.

2. The die of claim 1, wherein said outer side of said body has an annular channel therearound.

3. The die of claim 1, wherein said center bore of said body has a transverse axis extending substantially perpendicular to said center axis of said body and substantially parallel to said top and bottom faces of said body, wherein said outer periphery of said center bore comprises a pair of substantially parallel straight sides extending substantially parallel to said transverse axis of said center bore, and a pair of arcuate sides extending between said straight sides of said center bore.

4. The die of claim 1, wherein said top face of said body has a shaped upper recess therein, said upper recess having a lower surface, an open outer side periphery along said outer side of said body and a generally L-shaped inner side periphery adjacent said center bore of said body.

5. The die of claim 4, further comprising a stripper plate being disposed in said upper recess of top face of said body, wherein said stripper plate has upper and lower faces, an arcuate outer side, and a generally L-shaped inner side, wherein said lower face of said stripper plate faces said lower surface of said upper recess, wherein said outer side of said stripper plate is positioned adjacent said open outer side periphery of said upper bore, and wherein said inner side of said stripper plate is positioned adjacent said inner side periphery of said upper recess.

6. The die of claim 5, further comprising a plurality of springs being positioned in said upper recess between said lower surface of said upper recess and said lower face of said stripper plate.

7. The die of claim 1, wherein said inner and outer portions of said annular extent are extended generally parallel to one another generally perpendicular to said top face of said body, wherein said upper portion of said annular extent is extended generally perpendicular to said inner and outer portions of said annular extent and generally parallel to said top face of said body.

8. The die of claim 7, wherein said lower portion of said inner recess is extended substantially perpendicular to said upper portion of said inner periphery of said inner recess, wherein said upper portion of said inner periphery of said inner recess is extended substantially parallel to said inner portion of said annular extent, and wherein said lower portion of said inner periphery of said inner recess is extended substantially parallel to said top face of said body.

9. A die for forming a hole in a sheet-metal material having a collar around the periphery of the hole outwardly extending from a face of the sheet metal material, said die comprising:

a generally disk-shaped body having a center axis, substantially planar and generally circular top and bottom faces, and a generally cylindrical outer side;

said top and bottom faces of said body lying in planes substantially parallel to one another and substantially perpendicular to said center axis of said body;

said outer side of said body having an annular channel therearound;

said annular channel of said outer side lying in a plane substantially parallel to said top and bottom faces of said body;

said annular channel of said outer side being spaced generally equidistant between said top and bottom faces of said body;

said annular channel of said outer side having a generally arcuate transverse cross section taken in a plane in which said center axis of said body lies, said cross section of said annular channel having an outwardly facing concavity;

said body having a generally oblong center bore extending therethrough between said top and bottom faces of said body at said center axis of said body;

said center bore of said body having a transverse axis extending substantially perpendicular to said center axis of said body and substantially parallel to said top and bottom faces of said body;

said center bore of said body having an outer periphery comprising a pair of substantially parallel straight sides extending substantially parallel to said transverse axis of said center bore, and a pair of arcuate sides extending between said straight sides of said center bore;

said bottom face of said body having a generally cylindrical lower cavity therein, said lower cavity of said bottom face having a center coaxial with said center axis of said body;

said center bore of said body opening into said lower cavity of said bottom face;

a generally cylindrical elongate pin being extended through said body from said outer side of said body into said lower cavity of said bottom face;

said pin having an axis extending substantially perpendicular to said center axis of said body and substantially parallel to said top and bottom faces of said body;

said axis of said pin being extended substantially parallel to said transverse axis of said center bore;

said top face of said body having generally L-shaped upper recess therein, said upper recess having a lower surface, an open outer side periphery along said outer side of said body and a generally L-shaped inner side periphery adjacent said center bore of said body;

said lower surface of said upper recess lying in a plane substantially parallel to said top face of said body said inner side periphery of said upper recess being extended adjacent one of said straight sides of said center bore and one of said arcuate sides of said center bore;

a generally L-shaped stripper plate being disposed in said upper recess of top face of said body;

said stripper plate having substantially planar and parallel upper and lower faces, an arcuate outer side, and a generally L-shaped inner side;

said lower face of said stripper plate facing said lower surface of said upper recess;

said outer side of said stripper plate being positioned adjacent said open outer side periphery of said upper bore, said inner side of said stripper plate being positioned adjacent said inner side periphery of said upper recess;

said body having a pair of generally cylindrical set holes extending therethrough between said lower surface of said upper recess and said lower cavity of said bottom face of said body;

said stripper plate having a pair of threaded holes therethrough, each of said threaded holes of said stripper plate being coaxially aligned with a corresponding set hole of said pair of set holes of said body;

a pair of elongate set pins each having a threaded upper end and a lower stop opposite said upper end of the respective set pin;

each of said set pins being associated with a corresponding associated threaded hole of said stripper plate and set hole of said body;

said set pins each being extended through the associated set holes, said threaded upper end of each set pin being threadably inserted into the associated threaded hole of said stripper plate;

said lower stop of each set pin being positioned in said lower cavity of said bottom face of said body;

said body having a plurality of spring holes in said lower surface of said upper recess;

a plurality of springs being positioned in said upper recess between said lower surface of said upper recess and said lower face of said stripper plate;

each of said springs being associated with one of said spring holes, each spring being extended into the associated spring hole;

said springs biasing said stripper plate upwardly from said top face of said body such that said upper face of said stripper plate is biased to a position lying in a plane above said top face of said body;

said top face of said body having an annular extent upwardly extending therefrom around said outer periphery of said center bore;

said annular extent having an upper, inner and outer portions, said inner and outer portions of said annular extent being extended generally parallel to one another generally perpendicular to said top face of said body, said upper portion of said annular extent being extended generally perpendicular to said inner and outer portions of said annular extent and generally parallel to said top face of said body;

said inner portion of said annular extent having an annular inner recess therearound adjacent said upper portion of said annular extent;

said inner recess having a generally L-shaped inner periphery having an upper portion and a lower portion extending substantially perpendicular to said upper portion of said inner periphery of said inner recess;

said upper portion of said inner periphery of said inner recess being extended substantially parallel to said inner portion of said annular extent; and said lower portion of said inner periphery of said inner recess being extended substantially parallel to said top face of said body.

10. A die, comprising:

a body having a center axis, top and bottom faces, and an outer side;

said body having a center bore extending therethrough between said top and bottom faces of said body at said center axis of said body, said center bore of said body having an outer periphery;

said top face of said body having an annular extent upwardly extending therefrom around said outer periphery of said center bore;

said annular extent having an upper, inner and outer portions;

said inner portion of said annular extent having an annular inner recess therearound adjacent said upper portion of said annular extent; and wherein said top face of said body has a shaped upper recess therein, said upper recess having a lower surface, an open outer side periphery along said outer side of said body and a generally L-shaped inner side periphery adjacent said center bore of said body.

11. The die of claim 10, wherein said outer side of said body has an annular channel therearound.

12. The die of claim 10, wherein said center bore of said body has a transverse axis extending substantially perpendicular to said center axis of said body and substantially parallel to said top and bottom faces of said body, wherein said outer periphery of said center bore comprises a pair of substantially parallel straight sides extending substantially parallel to said transverse axis of said center bore, and a pair of arcuate sides extending between said straight sides of said center bore.

13. The die of claim 10, further comprising a stripper plate being disposed in said upper recess of top face of said body, wherein said stripper plate has upper and lower faces, an arcuate outer side, and a generally L-shaped inner side, wherein said lower face of said stripper plate faces said lower surface of said upper recess, wherein said outer side of said stripper plate is positioned adjacent said open outer side periphery of said upper bore, and wherein said inner side of said stripper plate is positioned adjacent said inner side periphery of said upper recess.

14. The die of claim 13, further comprising a plurality of springs being positioned in said upper recess between said lower surface of said upper recess and said lower face of said stripper plate.

15. The die of claim 10, wherein said inner and outer portions of said annular extent are extended generally parallel to one another generally perpendicular to said top face of said body, wherein said upper portion of said annular extent is extended generally perpendicular to said inner and outer portions of said annular extent and generally parallel to said top face of said body.

16. The die of claim 15, wherein said lower portion of said inner recess is extended substantially perpendicular to said upper portion of said inner periphery of said inner recess, wherein said upper portion of said inner periphery of said inner recess is extended substantially parallel to said inner portion of said annular extent, and wherein said lower portion of said inner periphery of said inner recess is extended substantially parallel to said top face of said body.

* * * * *